United States Patent [19]

Spamer

[11] Patent Number: 4,958,739

[45] Date of Patent: Sep. 25, 1990

[54] COMPOSITE ORGANIZER AND GRAVITY FEED SHELF

[75] Inventor: William S. Spamer, Roswell, Ga.

[73] Assignee: The Mead Corporation, Dayton, Ohio

[21] Appl. No.: 416,057

[22] Filed: Oct. 2, 1989

Related U.S. Application Data

[63] Continuation-in-part of Ser. No. 391,424, Aug. 9, 1989.

[51] Int. Cl.[5] ..... A47F 5/00

[52] U.S. Cl. ..... 211/153; 211/59.2

[58] Field of Search ..... 211/59.2, 184, 133, 211/175, 189, 153; 248/220.3

[56] References Cited

U.S. PATENT DOCUMENTS

| | | | |
|---|---|---|---|
| 3,452,959 | 7/1969 | Ishikawa | 248/220.3 X |
| 3,513,786 | 5/1970 | Kellogg | 211/153 X |
| 3,832,957 | 9/1974 | Mendenhall | 211/153 X |
| 4,460,096 | 7/1984 | Ricci | 211/153 X |
| 4,478,337 | 10/1984 | Flum | 211/59.2 |
| 4,690,287 | 9/1987 | Fershko et al. | 211/128 X |
| 4,724,968 | 2/1988 | Wombacher | 211/184 X |
| 4,782,959 | 11/1988 | Kral et al. | 211/59.2 |
| 4,785,943 | 11/1988 | Deffner et al. | 211/59.2 |
| 4,785,945 | 11/1988 | Rowse et al. | 211/59.2 |
| 4,801,025 | 1/1989 | Flum et al. | 211/153 X |

*Primary Examiner*—Robert W. Gibson, Jr.

*Attorney, Agent, or Firm*—Rodgers & Rodgers

[57] ABSTRACT

A composite structure for use as an organizer or gravity feed shelf is constructed with a flat bottom for mounting on a flat surface and includes main and auxiliary support units each having rectangular planar elements with complementary edges, a plurality of fastening projections formed along the complementary edges of the rectangular planar elements for disjointably connecting and for reassembling the planar elements so as to form a composite shelf unit, and a plurality of low friction longitudinal ribs integrally formed with the support units and their associated fastening projections.

12 Claims, 2 Drawing Sheets

COMPOSITE ORGANIZER AND GRAVITY FEED SHELF

This is a continuation-in-part of application Ser. No. 391,424 filed Aug. 9, 1989.

TECHNICAL FIELD

This invention pertains to a composite shelving structure for use as a gravity feed device or as a product organizing structure having a flat bottom surface and which is adapted for mounting on a flat supporting surface.

BACKGROUND ART

U.S. Pat. No. 4,690,287 issued Sept. 1, 1987 and owned by the assignee of this invention discloses a display device such as is used in refrigerators in supermarkets and the like and includes a main central portion together with side portions which are frangibly secured to the central portion so that removal of one or more frangible side portions effectively reduces the area and overall capacity of the display device so that it may fit various door widths.

U.S. Pat. No. 4,724,968 issued Feb. 16, 1988 discloses a display device wherein a composite structure is formed of interconnected elements.

U.S. Pat. No. 4,785,945 issued Nov. 22, 1988 discloses combinations of laterally interlocked modules.

U.S. Pat. No. 4,801,025 issued Jan. 31, 1989 discloses a shelf organizer unit having frangible side and rear portions.

U.S. patent application Ser. No. 391,424 filed Aug. 9, 1989 and owned by the assignee of this invention discloses a composite shelf organizer unit which is constructed of component parts which are disjointably connected and which are adapted for reassembly after disconnection.

SUMMARY OF THIS INVENTION

A composite shelf having a flat bottom surface is arranged for mounting on a flat surface for supporting and displaying articles and comprises main and auxiliary support units each having front, rear and opposed side edges, one edge of each unit being of complementary configuration to one edge of the other unit, a plurality of spaced projections formed along complementary edges of the main and auxiliary units and interspersed in such manner that the end portions of the projections of one group of projections are spaced longitudinally from the end portions of the projections of the other group so as to provide a junction between the units which is free of obstructions whereby sliding movement of displayed articles is accommodated without obstruction, and a plurality of low friction longitudinal ribs disposed atop the main and auxiliary units and their associated spaced projections.

BEST MODE OF CARRYING OUT THE INVENTION

Figure 1:
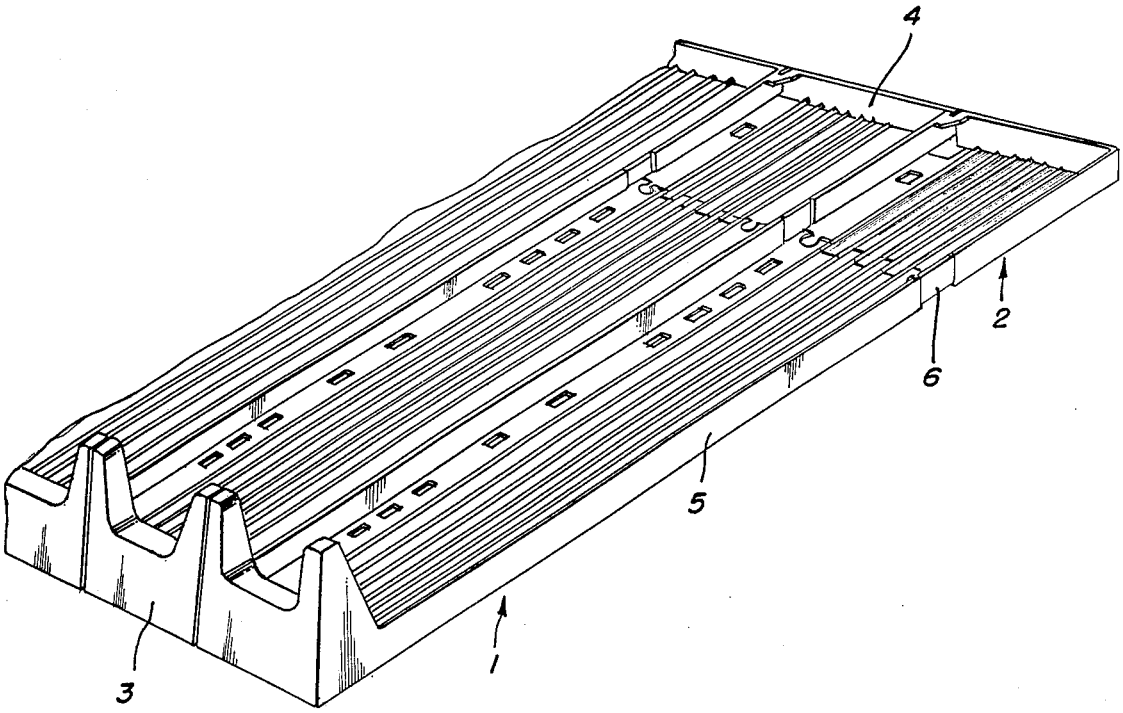
FIG. 1 is a perspective view of a portion of a composite shelf formed according to this invention.

In FIG. 1, a fragment of a main support unit which is of rectangular planar configuration is designated by the numeral 1. The numeral 2 designates an auxiliary support unit which is of rectangular planar configuration and which is shown in fragmentary form.

Figure 2:
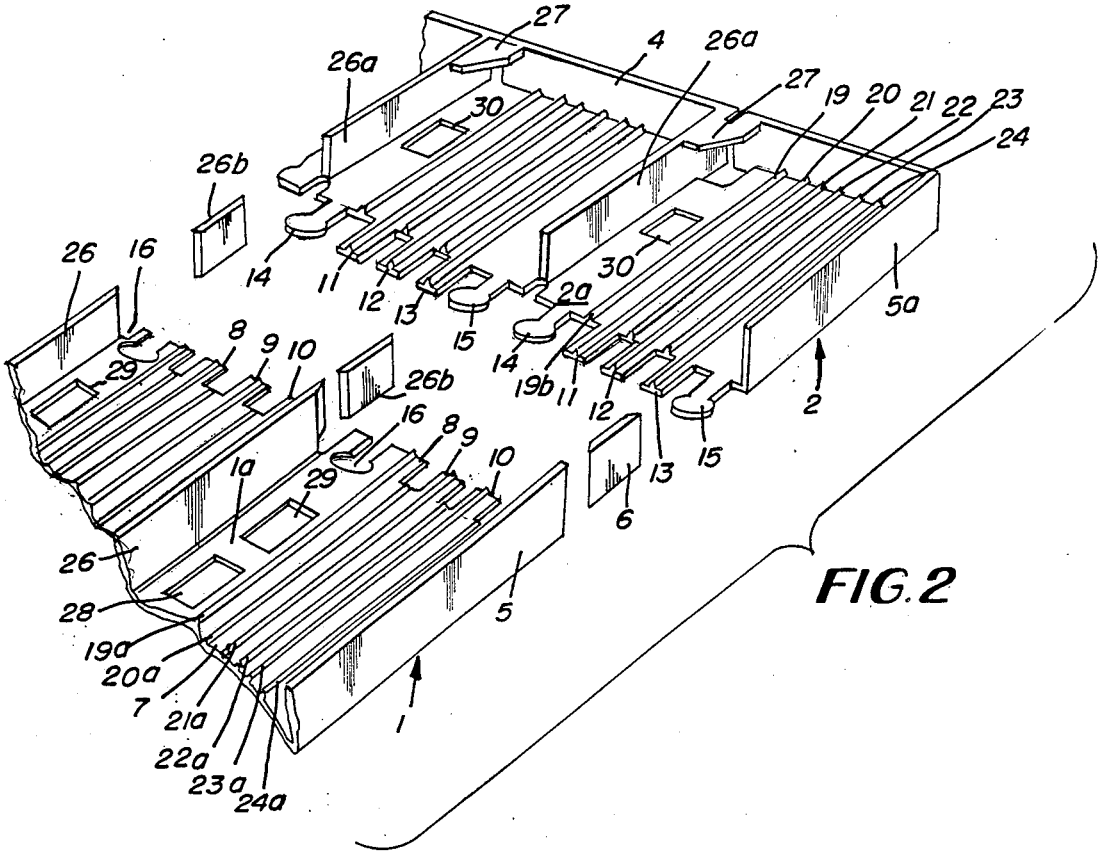
FIG. 2 is an exploded fragmentary perspective view of one end of a main support unit and of an auxiliary support unit.
Figure 3:
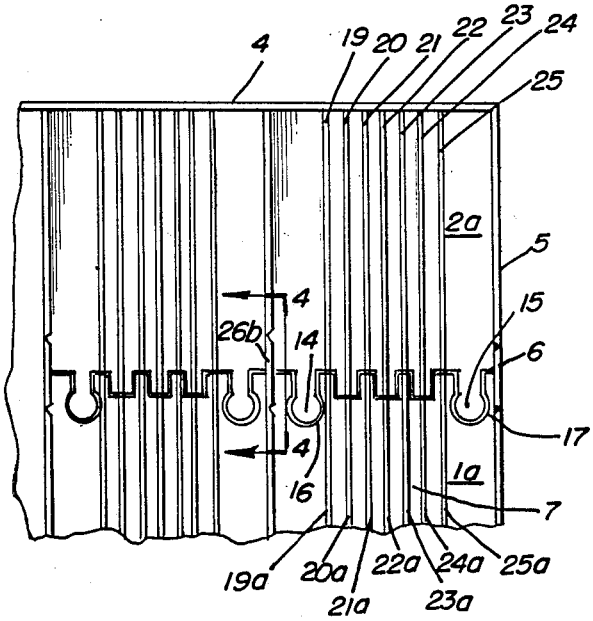
FIG. 3 is an assembled plan view of the structure shown in FIG. 2.
Figure 4:
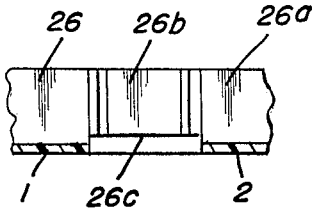
FIG. 4 is an enlarged cross sectional view taken along the line designated 4-4 in FIG. 3.

As is apparent from FIGS. 1, 2 and 3, the main and auxiliary support units include a front wall 3, a rear wall 4 and a side wall 5. A side wall is oppositely disposed from side wall 5 and forms a part of the broken away portions of FIGS. 1, 2 and 3 which is not shown. Side wall 5 includes a frangible tab 6.

As is best shown in FIGS. 2 and 3, main support unit 1 includes a flat planar generally rectangular element 1*a* having a plurality of rectangular projections 8, 9 and 10 formed in spaced relation to each other along one edge of rectangular planar element 1*a*. Similarly a plurality of rectangular projections 11, 12, and 13 project from the near end of auxiliary planar element 2*a*. Also, projections 14 and 15 extend from the near end of auxiliary planar element 2*a* and are of generally keyhole configuration. These projections cooperate with cutaway apertures 16 and 17 formed in main planar element 1*a*. Low friction ribs 19–25 are formed integrally with planar element 2*a* and similar ribs 19*a*–25*a* are formed integrally with planar element 1*a*. Each of these ribs may include a bevelled end such as is indicated at 19*b* in connection with rib 19.

During the molding of the main support unit 1 and the auxiliary support unit 2, molten material is injected into planar element 1 and 1*a* and thence into the remaining parts. When the structures are molded as indicated in FIG. 3, the breakaway tabs 26*b* allow molten material to pass from planar element 1 to planar element 2, and are disjointably connected at their ends with the corresponding ends of partitions 26 and 26*a* as is obvious from FIG. 2. These tabs may be removed, if desired, or may be retained during transit to a point of use and then may be removed.

For dividing the rectangular planar elements 1*a* and 2*a* into a plurality of channels, partition elements 26 and 26*a* are formed integrally with planar elements 1*a* and 2*a* respectively and project upwardly therefrom.

For the purpose of affording mechanical strength and stability to the structure, a reinforcing tab 27 is integrally formed with the upper edge of partitions 26*a* and of end wall 4 as is clearly shown in FIG. 2.

For allowing free circulation of ambient air, apertures 28 and 29 are formed in main rectangular element 1*a* and similar apertures 30 are formed in auxiliary planar element 2*a*. These apertures 28–30 are omitted from FIG. 3 for the sake of simplicity and may not be required for many applications of the invention.

As is shown in FIG. 3, the main and auxiliary planar elements of FIG. 2 are in assembled relationship. When so assembled, the breakaway tab 26*b* is shown in place. It should be observed that its lower edge 26*c* is spaced somewhat above the upper surface of main planar element 1 and of auxiliary planar element 2*a*.

When assembled as shown in FIG. 3, the keyhole projections such as 14 and 15 are disposed within the complementary keyhole structures 16 and 17 respectively and the rectangular projections 11, 12 and 13 are interspersed with the rectangular projections 8, 9 and 10, the projection 11 being interposed between projections 8 and 9, while the projection 12 is interposed between projections 9 and 10 and the projection 13 is interposed between projection 10 and the adjacent edge of bottom planar rectangular element 1*a*.

Since the bottom surfaces of the main and auxiliary support units are flat and since the units are specially adapted for mounting on a flat supported surface, it is obvious that the structures 1 and 2 are securely held together due to the fact that they occupy a common plane and also because of the weight of displayed articles which are disposed in known manner in each of the channels such as those disposed between the side wall 6 and the partition 26*a*, the side wall 1 and the partition 26.

As is apparent especially in FIG. 3, the end portions of the ribs such as 11–13 are spaced longitudinally from the end portions of the projections 8, 9 and 10. This feature is of particular importance because it insures that articles stacked atop the ribs for example such as ribs 19–25 in auxiliary planar element 2*a* may pass freely on to the low friction ribs 19*a*-25*a* in main support planar unit 1*a* because the end of each rib such as 21 is straddled by ribs 20 and 22 and is spaced longitudinally from the adjacent ends of the ribs 20 and 22 so that a collision of the articles with the end, for example, of rib 21*a* on the main planar element 1 is completely avoided in accordance with one feature of this invention.

As is obvious, the auxiliary support unit 2 may be constructed so that its rear end is adapted to cooperate with another auxiliary unit (not shown) and thus to increase the overall size and capacity of the shelf.

As is apparent from the above description, the main support unit 1 and the auxiliary support unit 2 are readily detachable one from the other in order to reduce the size of the overall unit. Furthermore, the units may be reassembled in order to restore the structure to the condition represented for example in FIG. 3 thus to provide a larger shelf. These assembly and reassembly operations are very simple and are performed with ease. Safety of the unit is insured due to the fact that it is specially adapted for support on a flat supporting surface which is engaged by the flat undersurface of main support unit 1 and of auxiliary support unit 2.

What I claim is:

1. A composite shelf arranged for mounting on a flat surface for supporting and displaying articles and comprising a main support unit including a main rectangular planar element having front, rear and opposed side edges, an auxiliary support unit including an auxiliary rectangular planar element having front, rear and opposed side edges one edge of which is of a configuration which is complementary to one edge of said main rectangular planar element, a first plurality of spaced projections formed along said one edge of said main planar element and disposed in the plane thereof, and a plurality of spaced projections formed along said one edge of said auxiliary planar element and in the plane thereof and interspersed between said spaced projections formed along said one edge of said main planar element.

2. A composite shelf according to claim 1 wherein a plurality of low friction longitudinal ribs are disposed atop said main and said auxiliary planar elements and in overlying relation with said first and said second plurality of spaced projections.

3. A composite shelf according to claim 1 wherein at least some of said first and said second pluralities of spaced projections are of rectangular configuration.

4. A composite shelf according to claim 1 wherein at least some of said projections extending from one of said planar elements are of keyhole configuration.

5. A composite shelf according to claim 4 wherein cutaway areas of keyhole configuration are formed in the other of said planar elements for receiving said projections which are of keyhole configuration.

6. A composite shelf according to claim 1 wherein the end portions of the projections which extend from one of said planar elements are spaced longitudinally from the end portions of the projections which extend from the other of said planar elements.

7. A composite shelf according to claim 1 wherein said main and said auxiliary planar elements are provided with a plurality of spaced aligned guide rails defining a plurality of channels for receiving rows of displayed articles and wherein said spaced aligned guide rails are severable near the junction between said main and said auxiliary planar elements.

8. A composite shelf according to claim 7 wherein a removable break-out tab is formed in said spaced aligned guide rails.

9. A composite shelf according to claim 1 wherein said main and said auxiliary planar elements are formed with flat planar bottom surfaces.

10. A composite shelf arranged for mounting on a flat surface for supporting and displaying articles and comprising a main support unit having front, rear and opposed side edges and a flat bottom surface, an auxiliary support unit including front, rear and opposed side edges and a flat bottom, one edge of said auxiliary support unit being complementary to one edge of said main support unit, a plurality of fastening projections extending from said one edge of one of said support units and disposed in the plane thereof, and a plurality of apertures formed in the other of said support units along said one edge thereof and oriented to receive in fastening relation corresponding ones of said fastening projections so as to hold said support units together in a common plane, said projections being removable and reinsertable into said apertures.

11. A composite shelf according to claim 10 wherein said fastening projections and said apertures are of keyhole configuration.

12. A composite shelf according to claim 11 wherein said support units are secured together while mounted on a flat surface but are severable upon removal of one of said support units from said flat surface.

* * * * *